US005529810A

United States Patent [19]

Sugawara

[11] Patent Number: 5,529,810

[45] Date of Patent: Jun. 25, 1996

[54] HOT-DIP ZINC PLATING METHOD AND ITS PRODUCT

[75] Inventor: Noriaki Sugawara, Toyama, Japan

[73] Assignee: Nippon Mining & Metals Co., Ltd., Tokyo, Japan

[21] Appl. No.: 337,381

[22] Filed: Nov. 8, 1994

[30] Foreign Application Priority Data

Dec. 27, 1993 [JP] Japan ..... 5-346893

[51] Int. Cl.[6] ..... C23C 2/00

[52] U.S. Cl. ..... 427/433

[58] Field of Search ..... 427/433; 428/659, 428/939

[56] References Cited

U.S. PATENT DOCUMENTS 5,141,781 8/1992 Suzuki et al. ..... 427/433

FOREIGN PATENT DOCUMENTS 60-125361A 7/1985 Japan .
201767A 9/1986 Japan .
61-295363A 12/1986 Japan .
62-60854A 3/1987 Japan .
1-283353A 11/1989 Japan .
3-100151A 4/1991 Japan .
3-229846A 10/1991 Japan .
4-19299B2 3/1992 Japan .
4-160143A 6/1992 Japan .
4-214848A 8/1992 Japan .
4-311553A 11/1992 Japan .
5-106002A 4/1993 Japan .
228727A 8/1994 Japan .

*Primary Examiner*—John Niebling
*Assistant Examiner*—Kishor Mayekar
*Attorney, Agent, or Firm*—Ronald J. Kubovcik

[57] ABSTRACT

When a hot-dip zinc plating layer, which contains Al, is applied on rimmed steel having Si level of less than 0.05% by weight or less, by the two-stage plating method, appearance failure can be prevented by setting the plating conditions as follows: in a first zinc bath consisting of zinc of 99.7% purity or more or in a second zinc bath which consists of zinc with 99.7% purity by weight or more and 0.05% or less of Al at a temperature of from more than 460° C. to 490° C. and for a dipping time of from 1 minute to 1.5 minutes; and, in a second zinc bath consisting of zinc of 99.7% purity by weight and from 2 to 10% by weight or less of Al at a temperature of from 400° C. to less than 430° C. and for a dipping time of from 0.5 minute to 1.5 minutes.

8 Claims, No Drawings

HOT-DIP ZINC PLATING METHOD AND ITS PRODUCT

BACKGROUND OF INVENTION

1. Field of Invention

The present invention relates to a method for hot-dip zinc galvanizing of steel materials, more particularly to a two-stage hot-dip zinc plating method.

The present invention also relates to rimmed steel, on which a hot-dip zinc plating layer containing Al is provided. The rimmed steel herein is not at all limited by its application and includes, for example, use for general construction, sheet material, plate material and the like. Furthermore, the usual components of the rimmed steel other than Si are 0.3% or less of C and 0.50% or less of Mn.

More specifically, the present invention relates to an improvement of the two-stage hot-dip zinc plating method, such that no failure in appearance occurs on the rimmed steel and the corrosion-resistance of hot-dip plating coating is improved.

2. Description of Related Arts

Heretofore, the general method for improving the corrosion-resistance of hot-dip zinc plated steel has been to increase the coating weight of the plating. In order to increase the coating weight of the plating, pre-treatment prior to the plating may be carried out by subjecting the steel to blasting. Alternatively, the dipping time in a fused zinc bath may be extended. In each case, it is intended to develop a Fe—Zn alloy layer and hence to increase the coating weight of the plating. Nevertheless, improvement of the corrosion-resistance falls short of expectation. Furthermore, the Fe—Zn layer may develop up to the surface of the coating layer, so that a phenomenon referred to as "yellowing" is incurred, which impairs the plating appearance and commercial value of the plated products.

In recent years, not only in the field of continuous hot-dip zinc galvanizing of a strip but also in hot-dip galvanizing of cut sheets, an Al—Zn alloy bath, which is a Zn bath with the addition of Al, has been used to suppress the formation of the Fe—Zn alloy layer and also to improve corrosion resistance. As long as a conventional flux is used, a preferential reaction occurs between the aluminum of the Zn—Al alloy bath and Cl of the flux, with the result that the alloying reaction between the steel and Al—Zn is impeded, thereby generating a phenomenon referred to as the "non-plating".

In order to solve the above described problems, Japanese Unexamined Patent Publication No. Sho 60-125,361, Japanese Examined Patent Publication No. Hei 01-5,110, and Japanese Unexamined Patent Publication No. Hei 03-100, 151 propose a special flux which does not impede the formation of an Al—Zn alloy plating.

Japanese Unexamined Patent Publication No. Sho 53-47, 055; and Japanese Unexamined Patent Publication No. Hei 05-106,002 propose to add a third element to the Al—Zn alloy bath so as to form an Al—Zn alloy plating by a single dipping.

Japanese Unexamined Patent Publication No. Sho 61-201,767 proposes to form a plating coating by means of hot dipping in a Zn bath without the addition of Al and then to supply Al into the plating coating by means of dipping in an Al—Zn alloy bath. According to this method, the Al—Zn alloy plating layer can be thinly formed by a two-stage plating method. In an example of the above Japanese Unexamined Patent Publication No. Sho 61-201,767, the plating is applied on steel for constructional use (SS41 corresponding to ISO Standard SS400).

Heretofore, the steel material, on which the Al—Zn alloy plating is applied, is not specified in most of the Japanese patent applications, although it may occasionally be specified such as high-tensile steel as in Scope of Claim for Patent (Japanese Unexamined Patent Publication No. Hei 04-311, 553) or in Examples (for example in Japanese Unexamined Patent Publication No. Hei 05-106,002, or SPCC in Japanese Unexamined Patent Publication No. 53-47,055).

Previously, hot-dip zinc plating was considered to be applicable to either rimmed steel, semi-killed steel or killed steel ("The Making, Shaping and Treating of Steel", edited by United Steel Corporation, pages 356 and 357 of the Japanese Translation, second edition, third printing).

SUMMARY OF INVENTION

The present inventors carried out Al—Zn alloy plating on steel materials in a commercial scale, plant relying on known, two-stage methods and methods of adding a third element. It turned out that appearance failures, which have not occurred in the case of an experimental, small-size plating plant generated on the rimmed steel. Appearance failures such as rough deposits and ripple-form wrinkles were observed on the entire alloy-plating coating formed on the steel material. Another appearance failure is a defect in the plating coating where the thickness of the plating coating decreases drastically. The commercial value of the plated product is impaired when any one of such appearance failures occurs.

Because of the reasons as described above, a hot-dip Al—Zn plating coating with improved corrosion-resistance, could not be successfully applied on the rimmed steel. The plating manufacturers took countermeasures, therefore, with application of ordinary hot-dip zinc plating with a corrosion-resistance property inferior to that of the Al—Zn alloy plating.

It is, therefore, an object of the present invention to provide a hot-dip zinc plating method, in which no appearance failure occurs when hot-dip Al—Zn alloy plating is applied on rimmed steel having Si level of less than 0.05% by weight.

It is also an object of the present invention to provide a hot-dip zinc plated rimmed steel which can attain corrosion-resistance at least five times as high as that of the current hot-dip zinc plating and in which no appearance failure occurs.

In accordance with an object of the present invention, there is provided a hot-dip zinc plating method, comprising:

a first hot-dip zinc plating step, in which rimmed steel having Si level of less than 0.05% by weight is subjected to plating in a first zinc bath, which consists of zinc of 99.7% purity by weight or more, or in a second zinc bath, which consists of zinc of 99.7% purity by weight or more and to which 0.05% by weight or less of Al is added, at a temperature of from more than 460° C. to 490° C. and for a dipping time of from 1 minute to 1.5 minutes; and, a second hot-dip zinc plating step, in which the rimmed steel subjected to the first plating step is subsequently subjected to plating in a second zinc bath consisting of zinc of 99.7% purity by weight and from 2 to 10% by weight of Al at a temperature of from 400° C. to less than 430° C. and for a dipping time of from 0.5 minute to 1.5 minutes.

In accordance with another object of the present invention there is also provided a hot-dip zinc plated steel, comprising:

rimmed steel having Si level of less than 0.05% by weight; and, a hot-dip zinc plating layer consisting essentially of from 5 to 30% by weight of Al, not more than 20% by weight of Fe, the balance being essentially Zn, which layer is formed by a first hot-dip zinc plating step in a first zinc bath, which consists of zinc of 99.7% purity by weight or more or in a second zinc bath which consists of zinc of 99.7% purity by weight or more, and to which 0.05% by weight or less of Al is added, at a temperature of from more than 460° C. to 490° C. and for a dipping time of from 1 minute to 1.5 minutes; and, a second hot-dip zinc plating step in a second zinc bath, which consists of zinc of 99.7% purity by weight and, to which from 2 to 10% by weight or less of Al is added, at a temperature of from 400° C. to less than 430° C. and for a dipping time of from 0.5 minute to 1.5 minutes.

DESCRIPTION OF PREFERRED EMBODIMENTS

The first hot-dip zinc plating step is first described.

Purity of the zinc plating bath is 99.7% by weight or more, because at purity less than this value the desired corrosion-resistance is not obtained. For example, the purest zinc metal, electric zinc metal, distilled zinc metal obtained by a double condensing method and the like can be used for preparing the zinc plating bath. Al may or may not be added to the zinc plating bath. Al, when added to the zinc plating bath, suppresses excessive growth of the Fe—Zn alloy layer. The addition amount of Al is 0.05% by weight or less, because Al added in greater amount than this value results in generation of non-plating even in the first step, and no plating coating can be formed in the second step on the defective portions where the non-plating has occurred.

In addition, the bath temperature in the first plating step is 460° C. at the lowest because, at a temperature lower than this value, the plating structure does not develop sufficiently in the plating coating formed on the rimmed steel and, hence, the thickness of the plating coating is very small. Even when the second plating is applied on such thin plating coating, formation of a plating structure having improved corrosion-resistance cannot be expected. The bath temperature of the first plating is 490° C. at the highest because at a temperature exceeding this value, the Fe—Zn alloy layer in the plating coating undergoes structural change such that generation of appearance failure after the second plating step is accelerated. The dipping time is 1 minute at the shortest so as to obtain the necessary thickness of the Fe—Zn alloy layer as the underlying layer of the second plating coating. The dipping time is 1.5 minute at the longest, because at a dipping time longer than this value the Fe—Zn alloy layer grows unnecessarily so that "yellowing" occurs or formability of the plated steel is impaired.

Preferable condition of the first hot-dip zinc plating is a bath temperature of from more than 460° C. to 480° C. The second hot-dip plating step is now described.

Aluminum in an amount of 2% by weight or more is added to the fused zinc bath to enhance the corrosion-resistance of the hot-dip zinc plating layer. The addition amount of aluminum is 10% by weight at the highest, because aluminum added in greater amount than this value raises the temperature of the plating bath and incurs appearance failure.

The bath temperature in the second hot-dip plating is 400° C. at the lowest because, at a temperature lower than this value, viscosity of the bath increases to the extent that appearance failure occurs in the case of plating on rimmed steel. The bath temperature is less than 430° C. because, at a temperature higher than this value, appearance failure occurs in the case of plating on rimmed steel. More specifically, the first plating layer formed on the surface of steel having Si level of less than 0.05% by weight has a coating structure which is somewhat different from that of a coating layer formed on steel having an Si level of 0.05% by weight or more, i.e., the so-called killed steel. In addition, the second plating layer formed on the steel having Si level of less than 0.05% by weight has a coating structure which is somewhat different from that of a coating layer having Si level of 0.05% by weight or more. The plating-coating structure, which is formed on steel with an Si level of less than 0.05% by weight at a temperature of 430° C. or more, is unique and causes the generation of appearance failure.

The dipping time is 0.5 minute at the shortest, which is the minimum reaction time necessary for forming the plating-coating structure having improved corrosion-resistance. The dipping time is 1.5 minutes at the longest, because at a dipping time longer than this value, the effects of hot-dip plating reach saturation and, occasionally, the reaction to form the coating structure exceeds the limit where good appearance can be maintained.

Preferable condition for the second hot-dip plating is an Al content of from 4 to 8% by weight and bath temperature of from 420° C. to less than 430° C.

Incidentally, Japanese Unexamined Patent Publication No. Sho 61-201,767 filed by the present assignee discloses a method for forming a hot-dip zinc alloy plating layer, in which a plating coating with improved corrosion-resistance and without appearance failure is formed on killed steel with an Si level of 0.05% by weight or more. Specifically neither rough deposits, ripple-form wrinkles, nor deficient plating in the coating occur on the killed steel. In addition, when the inventive method is applied to form a hot-dip zinc plating coating on the killed steel, the plating coating thus formed exhibits good corrosion-resistance which is, however, inferior to that attained by the Japanese patent publication mentioned above.

The hot-dip zinc alloy plating layer having Al concentration of from 5 to 30% by weight exhibits corrosion-resistance five times or more in terms of the salt-water spraying test stipulated under JIS-Z-2371 as compared with the conventional hot-dip zinc plating coating. The iron concentration in the hot-dip zinc alloy plating layer preferably does not exceed 20% by weight, because at an iron concentration greater than this value, the reaction to form the coating structure exceeds the limit where good appearance can be maintained. More preferable iron content is from 3 to 15% by weight.

The coating thickness of hot-dip zinc plating according to the present invention is preferably from 50 to 100 μm.

The present invention is hereinafter described by way of examples.

EXAMPLES

Steel sheets were bent and welded to form an article shape, and the so produced articles were subjected to conventional pre-treatment in the conventional hot-dip zinc galvanizing of a sheet, which comprises degreasing, pickling, and pre-fluxing. Subsequently, the steel sheets were subjected to hot-dip zinc plating under the inventive condition, a condition outside the inventive range and the conventional condition.

Test samples were then prepared to compare the appearance and corrosion-resistance. The test samples for evaluating appearance had dimensions ranging from 50 mm in width/300 mm in length to 1 m in width/1.5 m in length. The appearance evaluation was made by the naked eye taking the conventional hot-dip zinc plating coating as the standard criterion. The degree of commercial value was then judged. That is, ○ mark indicates that the samples have commercial value in line with conventional hot-dip zinc plating coating. The x mark indicates that appearance failure was generated. In this case, the form of appearance failure is recorded.

The test samples for corrosion-resistance evaluation were cut into a size 50 mm in width and 100 mm in length, so as to avoid inclusion into the evaluation of the difference in size factor which exerts an influence upon the corrosion-resistance. The surface area of the test samples was masked with paint except for the portion for the corrosion-resistance evaluation. The test samples were then subjected to the salt-water spraying test stipulated under JIS-Z-2371 in a corrosion-accelerating mode. Corrosion weight-loss ($g/m^2$) after 240 hours of test was measured. The exposure time to the salt water spray was set at 240 hours, because red rust generated on the samples prepared by the conventional method and, hence, judgment was made when the salt spray test was ended.

In addition, the time until generation of red rust on the samples was measured.

Upon comparing the corrosion-resistance of the test samples with one another, the multiplying coefficient of corrosion-resistance is defined as below to numerically evaluate the corrosion-resistance.

The corrosion-resistance multiplying coefficient=(the red-rust generation time of inventive product/the red-rust generation time of conventional hot-dip zinc galvanized sheet)× (average coating-thickness of the conventional hot-dip zinc galvanized sheet/average coating thickness of the inventive product).

In Table 1, the results of appearance evaluation are shown, and in Table 2 the results of corrosion-test are shown.

Sample Nos. 1 through 5 are produced by the inventive method. In Sample Nos. 1 through 3, the Al level in the second hot-dipping plating bath is varied. In Sample Nos. 4 and 5, the conditions of the first and second hot-dip plating bath are varied. On the other hand, Sample Nos. 6 through 13 correspond to the comparative examples, in which the plating conditions and the steel composition are varied. Sample No. 14 corresponds to a conventional example of the hot-dip zinc galvanizing of cut sheets.

Appearance failure occurs on steel having Si level less than 0.05% by weight, when the plating conditions lie outside the inventive ranges. Appearance failure on steel having Si level of 0.05% by weight or more does not occur, even when the plating conditions lie outside the inventive ranges.

In Table 2, the results of the corrosion test as described above are indicated. It is noted, however, that the corrosion-resistance multiplying coefficient is obtained with regard to the identical steel materials, on which the plating coating was applied by the inventive and comparative methods, respectively, so as to exclude any influence of difference in the steel material upon the corrosion-resistance. Also, the red-rust generating time longer than 3000 hours according the inventive samples indicates that the mask degraded and, later, exact evaluation of red rust became impossible.

As is clear from Table 2, the inventive method and the comparative method present a great difference in the corrosion weight-loss at 240 hours after initiation of the salt-water spray test. In addition, the inventive method and the comparative method present a difference of more than five times in the multiplying coefficient which is based on the time until red-rust generation.

The ripple-form wrinkles, i.e., one form of appearance failure, indicate that a portion(s) of the plating coating swells in a linear pattern. The rough deposits indicate that the plating coating swells less than the ripple-form wrinkles but the swelling is distributed more finely than the ripple-form wrinkles. The deficient plating indicates that the plating coating locally fails, decreasing the plating thickness.

As is described hereinabove, the plating coating provided by the method of the present invention exhibits considerably improved corrosion-resistance so that it would maintain the rust-proofing for a long period of time under severe environmental conditions. This leads not only to save such natural resources as zinc metal for the plating use and steel material, but also to reduce the maintenance cost of the plated construction.

In the plated steel construction, various steel materials, such as killed steel, rimmed and semi-killed steel, may be welded together. The present invention also provides a hot-dip zinc-alloy plated coating having improved corrosion-resistance on such steel construction.

TABLE 1

| | Com- | 1st Plating | | 2nd Plating | | | Average | | | |
|---|---|---|---|---|---|---|---|---|---|---|
| No. | position of steel (wt %) | Bath temperature (°C.) | Dipping Time (min.) | Composition of bath (Al wt %) | Bath temperature (°C.) | Dipping Time (min.) | thickness of coating (μm) | Evaluation of appearance | Form of appearance failure | Remarks |
| 1 | 0.01 | 470 | 1.0 | 6.0 | 425 | 1.0 | 61 | ○ | — | Inventive |
| 2 | 0.01 | 470 | 1.0 | 7.0 | 425 | 1.0 | 57 | ○ | — | " |
| 3 | 0.01 | 470 | 1.0 | 8.0 | 425 | 1.0 | 54 | ○ | — | " |
| 4 | 0.03 | 463 | 1.5 | 5.9 | 423 | 1.0 | 62 | ○ | — | " |
| 5 | 0.03 | 481 | 1.25 | 4.8 | 423 | 0.5 | 58 | ○ | — | " |
| 6 | 0.01 | 470 | 1.0 | 6.0 | 450 | 1.0 | 81 | x | *1 | Comparative |
| 7 | 0.01 | 470 | 1.0 | 7.0 | 450 | 1.0 | 69 | x | " | " |
| 8 | 0.01 | 470 | 1.0 | 8.0 | 450 | 1.0 | 67 | x | " | " |
| 9 | 0.03 | 480 | 0.5 | 4.8 | 440 | 0.5 | 72 | x | *1 *2 | " |
| 10 | 0.03 | 440 | 1.0 | 4.8 | 423 | 0.5 | 45 | x | *3 | " |

TABLE 1-continued

| No. | Composition of steel (wt %) | 1st Plating Bath temperature (°C.) | 1st Plating Dipping Time (min.) | 2nd Plating Composition of bath (Al wt %) | 2nd Plating Bath temperature (°C.) | 2nd Plating Dipping Time (min.) | Average thickness of coating (μm) | Evaluation of appearance | Form of appearance failure | Remarks |
|---|---|---|---|---|---|---|---|---|---|---|
| 11 | 0.16 | 462 | 1.5 | 5.9 | 423 | 1.0 | 86 | o | — | " |
| 12 | 0.20 | 445 | 2.5 | 4.8 | 440 | 1.0 | 107 | o | — | " |
| 13 | 0.20 | 454 | 2.5 | 5.9 | 423 | 1.0 | 127 | o | — | " |
| 14 | 0.01 | 470 | 1.0 | — | — | — | 70 | o | — | Conventional |

*1 - ripple form wrinkle,
*2 - deficient plating,
*3 - rough deposit

TABLE 2

| No. | Composition of steel (Si wt %) | 1st Plating Bath temperature (°C.) | 1st Plating Dipping Time (min.) | 2nd Plating Composition of bath (Al. wt %) | 2nd Plating Bath temperature (°C.) | 2nd Plating Dipping Time (min.) | Average thickness of coating (μm) | Corrosion weight loss at 240 hr ($g/m^2$) | Time until red rust generation (hr) | Multiplying coefficient formula (1) |
|---|---|---|---|---|---|---|---|---|---|---|
| 15 | | 472 | 1.25 | 5.9 | 422 | 0.75 | 78 | 45.9 | >3,000 | |
| | 0.01 | | | | | | | | | >10 |
| 16 | | 480 | 0.83 | — | — | — | 67 | 280.9 | 240 | |
| 17 | | 480 | 1.0 | 5.9 | 422 | 1.0 | 64 | 59.0 | >3,000 | |
| | 0.01 | | | | | | | | | >13 |
| 18 | | 481 | 0.83 | — | — | — | 70 | 279.8 | 240 | |
| 19 | | 467 | 1.0 | 5.9 | 424 | 0.75 | 58 | 42.5 | >3,000 | |
| | 0.01 | | | | | | | | | >16 |
| 20 | | 468 | 1.67 | — | — | — | 77 | 303.8 | 240 | |
| 21 | | 454 | 2.5 | 5.9 | 423 | 1.0 | 127 | 27.7 | >3,000 | |
| | 0.20 | | | | | | | | | >8 |
| 22 | | 464 | 1.17 | — | — | — | 87 | 129.6 | 240 | |

I claim:

1. A hot-dip zinc plating method, comprising:

subjecting a rimmed steel having a Si level of less than 0.05% by weight to plating in a first zinc bath at a temperature of from more than 460° C. to 490° C. and for a dipping time of from 1 minute to 1.5 minutes, said first zinc bath being selected from the group consisting of a zinc bath consisting essentially of zinc having a purity of at least 99.7% by weight and a zinc bath consisting essentially of zinc having a purity of at least 99.7% by weight and 0.05% by weight or less of Al; and subjecting said rimmed steel plated in said first zinc bath to plating in a second zinc bath at a temperature of from 400° C. to less than 430° C. and for a dipping time of from 0.5 minute to 1.5 minutes, said second zinc bath consisting essentially of zinc having a purity of at least 99.7% by weight and from 2 to 10% by weight of Al.

2. A hot-dip zinc plating method according to claim 1, wherein the temperature of the first zinc bath is from more than 460° C. to 480° C.

3. A hot-dip zinc plating method according to claim 1, wherein the temperature of the second zinc bath is from 420° C. to less than 430° C.

4. A hot-dip zinc plating method according to claim 3, wherein the Al concentration of the second zinc bath is from 4 to 8% by weight.

5. A hot-dip zinc plating method according to claim 1, wherein a welded construction of said rimmed steel and at least one material selected from killed steel and semi-killed steel is subjected to the first hot-dip zinc plating step and then the second hot-dip zinc plating step.

6. A hot-dip zinc plating method according to claim 2, wherein the temperature of the second zinc bath is from 420° C. to less than 430° C.

7. A hot-dip zinc plating method according to claim 6, wherein the Al concentration of the second zinc bath is from 4 to 8% by weight.

8. A hot-dip zinc plating method according to claim 2, wherein a welded construction of said rimmed steel and at least one material selected from killed steel and semi-killed steel is subjected to the first hot-dip zinc plating step and then the second hot-dip zinc plating step.

* * * * *